US007036336B2

(12) United States Patent
Bellott et al.

(10) Patent No.: US 7,036,336 B2
(45) Date of Patent: May 2, 2006

(54) SOLDERED CONDENSER

(75) Inventors: Frederick Bellott, Sarre-Union (FR); Patrick Jung, Roth (FR); Frederic Seibert-Sandt, Saint Avold (FR)

(73) Assignee: Behr France Hambach, Hambach (FR)

( * ) Notice: Subject to any disclaimer, the term of this patent is extended or adjusted under 35 U.S.C. 154(b) by 0 days.

(21) Appl. No.: 10/500,368

(22) PCT Filed: Dec. 14, 2002

(86) PCT No.: PCT/EP02/14273

§ 371 (c)(1),
(2), (4) Date: Jun. 28, 2004

(87) PCT Pub. No.: WO03/056259

PCT Pub. Date: Jul. 10, 2003

(65) Prior Publication Data

US 2005/0016206 A1 Jan. 27, 2005

(30) Foreign Application Priority Data

Dec. 28, 2001 (DE) ..... 101 64 668

(51) Int. Cl.
*F25B 39/04* (2006.01)

(52) U.S. Cl. ..... 62/509; 62/512

(58) Field of Classification Search ..... 62/473, 62/474, 503, 509, 512; 165/110, 149; 29/890.06; 228/173.4

See application file for complete search history.

(56) References Cited

U.S. PATENT DOCUMENTS

| | | | | |
|---|---|---|---|---|
| 5,419,141 | A * | 5/1995 | Burk | 62/474 |
| 5,487,279 | A * | 1/1996 | Eybergen et al. | 62/474 |
| 5,537,839 | A | 7/1996 | Burk et al. | |
| 5,666,791 | A * | 9/1997 | Burk | 62/474 |
| 5,761,808 | A * | 6/1998 | Patel et al. | 29/890.052 |
| 5,875,650 | A * | 3/1999 | Nobuta et al. | 62/509 |
| 5,946,938 | A * | 9/1999 | Balthazard | 62/507 |
| 5,946,940 | A * | 9/1999 | Inoue | 62/509 |
| 5,992,174 | A | 11/1999 | Mittelstrass | |
| 6,158,503 | A * | 12/2000 | Gille et al. | 165/132 |
| 6,260,379 | B1 * | 7/2001 | Manwill et al. | 62/509 |
| 6,349,562 | B1 | 2/2002 | Kaspar et al. | |
| 6,446,714 | B1 * | 9/2002 | Kaspar et al. | 165/175 |
| 6,494,059 | B1 * | 12/2002 | Yamazaki et al. | 62/509 |
| 6,629,560 | B1 * | 10/2003 | Kaspar et al. | 165/41 |

FOREIGN PATENT DOCUMENTS

| | | | |
|---|---|---|---|
| DE | 42 38 853 | A1 | 5/1994 |
| DE | 19848744 | A1 * | 4/2000 |
| DE | 100 39 260 | A1 | 3/2001 |
| EP | 0 867 670 | A2 | 9/1998 |
| EP | 1 079 186 | A1 | 2/2001 |
| FR | 2 750 761 | A1 | 1/1998 |

* cited by examiner

*Primary Examiner*—Mohammad M. Ali
(74) *Attorney, Agent, or Firm*—Foley & Lardner LLP

(57) ABSTRACT

The invention relates to a soldered condenser for a motor vehicle air conditioning unit, comprising a pipe/rib block, collector pipes which are arranged on both sides thereof and receive the ends of the pipes, and a collector which is arranged parallel to one of the collector pipes, fluidically connected to the adjacent collector pipe via two openings and receives a dryer/filter cartridge. The collector (1) is provided with a first soldered sealing part (5) to which the dryer/filter cartridge is mechanically connected. A second sealing part (6) is nondetachably connected to the collector (1, 4).

14 Claims, 1 Drawing Sheet

SOLDERED CONDENSER

BACKGROUND OF THE INVENTION

The invention relates to a soldered/brazed condenser of the general type disclosed by EP 0 867 670 A2.

In the known condenser, after the soldering/brazing process the dryer/filter cartridge is moved into the collector, positioned there and the collector is then closed in a pressure-tight fashion by a screwed connection. Since the dryer/filter cartridge is not subjected to the high temperatures of the soldering/brazing process, it is constructed from plastic and connected to the closure lid by a clip connection, and as a result the dryer/filter cartridge can, on the one hand, be mounted together with the closure lid, but, in the case of a repair or servicing, it can also be replaced together with the closure lid.

The design and the function of such a condenser are described more precisely in DE-A 42 38 853.

In the course of the development of such a soldered/brazed coolant condenser, EP-A 1 079 186 has already proposed a nonreplaceable dryer cartridge which is arranged in a collector which at the end side in each case has a closed connection. Such a dryer can therefore not be replaced without disruption. A disadvantage with this known dryer which is not replaceable is that it is not secured in the collector but rather can move within the collector. This leads to undesired abrasion and noises.

SUMMARY OF THE INVENTION

The object of the present invention is to improve a condenser of the type mentioned at the beginning to the effect that it can be manufactured easily and cost-effectively and its function is not adversely affected, in particular with respect to drying and filtering.

The means of achieving this object comprises a condenser for a motor vehicle air-conditioning system, comprising a block of finned tubes, header tubes which are arranged on opposing sides of the tube block and which receive the respective ends of the finned tubes, a collector which is arranged in parallel with a first one of the header tubes and which is in fluid communication with said first header tube, and a dryer/filter cartridge positioned inside of the collector, wherein the collector comprises a first soldered-in closure part non-detachably closing a first end of the collector, wherein the dryer/filter cartridge is mechanically connected to the first closure part, and wherein the collector comprises a second closure part non-detachably connected to and closing the second end of the collector. The advantage of this combination of features for a dryer/filter cartridge which cannot be replaced is that, firstly, an inexpensive plastic housing can be used for the dryer/filter cartridge, that the tube for the collector can be manufactured from a simple semifinished tube without additional processing, and that the dryer/filter cartridge is securely positioned and attached in the collector so that its satisfactory function is ensured for the drying of the coolant and the filtering.

Further advantageous refinements of the invention are disclosed. Here, the attachment of the dryer/filter cartridge by means of a clip connection at the bottom is advantageous in that a first metallic part of this clip connection, an armature part, is already present in finished form by virtue of the soldering/brazing process of the condenser. The dryer/filter cartridge, which is manufactured from plastic and is provided with latching elements which are formed integrally on the bottom by injection molding, merely has to be pushed into the collector pipe and clipped to the bottom. This results in a simple and uncomplicated mounting which in turn reduces the manufacturing costs. After the dryer/filter cartridge has been mounted and attached in the collector, the latter is closed by inserting and soldering the cover plate, for example, by soft-soldering. However, the closing process can also be carried out by means of a different nondetachable materially joined connection, for example, welding or bonding, calking or flanging.

In a further refinement of the invention, a method is advantageous which includes cost-effective mounting and the manufacture by oven-brazing, clipping and closing the container in three successive method steps. This method also contributes to reducing the manufacturing costs.

BRIEF DESCRIPTION OF THE DRAWINGS

An exemplary embodiment of the invention is illustrated in the drawings and will be described in more detail below. In the drawings.

DETAILED DESCRIPTION OF THE PREFERRED EMBODIMENTS

Figure 1:
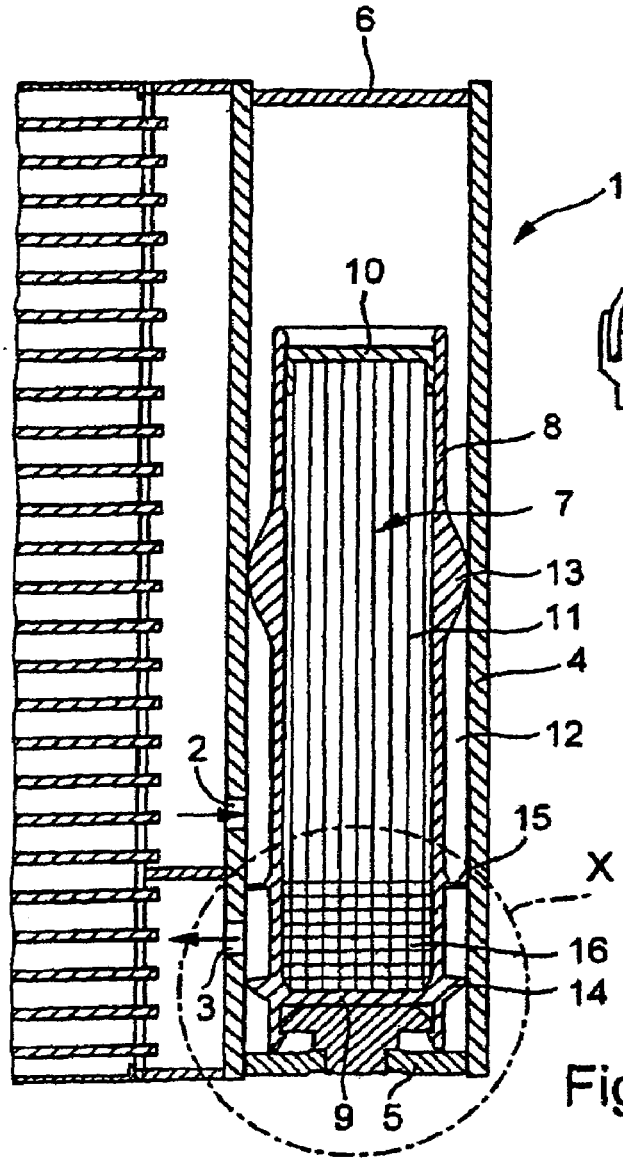
FIG. 1 is a cross-sectional view showing a collector for a coolant condenser.

FIG. 1 shows a collector 1 for a coolant condenser (not completely illustrated) according to the prior art, for example, in accordance with DE-A 42 38 853. Such condensers are referred to as a condenser module because the collector is structurally integrated into the condenser, i.e., it is arranged in parallel with one of the two collector or header tubes and is connected to it in a manner permitting refrigerant communication between the two components. The collector or header 1 therefore has a refrigerant inflow opening 2 and a refrigerant outflow opening 3. Via these two openings, the collector is therefore connected at the refrigerant side to a collector tube of a condenser. The collector 1 is composed of an aluminum tube 4 which is matched in terms of its wall thickness and strength to the operating pressure of the condenser. The tube 4 is closed at the ends by a disk 5 at the bottom and a disk 6 at the upper end. In the interior of the tube 4, there is a dryer/filter cartridge 7 which is composed of a cage-like plastic housing 8 and holds in it a dryer granulate (not illustrated). The cage-like plastic housing 8 forms an enclosed space which is closed off at the bottom by a bottom part 9 and at the top by a clipped-in lid 10, but is open to the outside through slit-like openings 11. An annular gap 12 is left between the housing 8 and the tube 4. The plastic cage 8 has, in its upper region, a circumferential bead-like thickened portion 13, and in its bottom region, i.e., below the outflow opening 3, a similar annular bead 14. The thickened portion 13 and annular bead 14 are both in contact with the inner wall of the tube 4. This ensures that the plastic cage 8 is oriented in the housing 4. In the region between the two openings 2 and 3, a circumferential sealing lip 15 is integrally formed on the plastic housing 8 by injection molding, said sealing lip 15 causing the plastic housing 8 to be sealed with respect to the inner wall of the tube 4. From the level of the sealing lip 15 as far as the bottom region 9, the plastic housing 8 is surrounded (or lined) with a fine mesh sieve 16 in order to trap impurities in the form of extremely small particles in the housing 8.

This sieve 16 therefore functions as a filter.

Figure 2A:
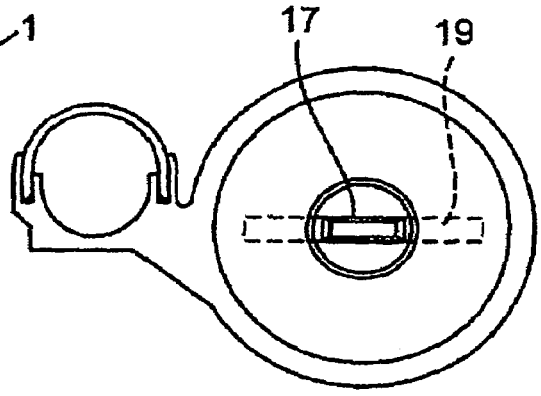
FIGS. 2, 2*a* are, respectively, a cross-sectional view showing a detail of the collector in the bottom region and a bottom end view of te collector.
Figure 2:
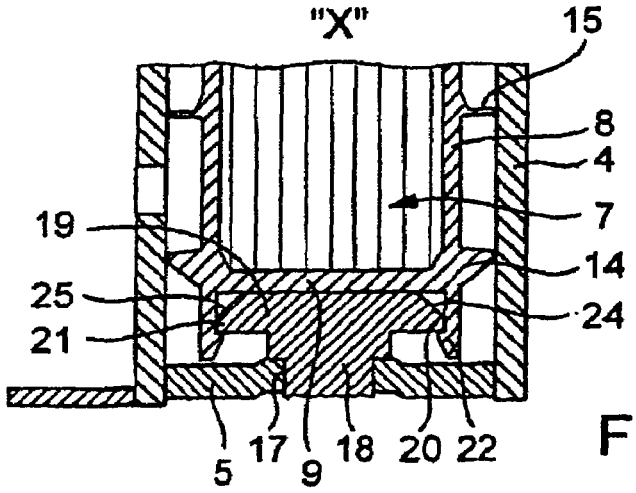

A detail, designated by X, in the bottom region of the collector 1 is illustrated in FIG. 2 and shows in particular the attachment of the dryer/filter cartridge 7 to the bottom plate 5. The bottom plate 5 is soldered/brazed into the tube 4, i.e., it forms a materially joined, nondetachable connection to the tube 4 at the circumference. In the center region, the bottom plate 5 has an approximately rectangular slit 17 which can be seen as such also in FIG. 2*a*. An armature part 19 is inserted and soldered/brazed so as to fit into this slot 17 by means of a plug-in part 18 with the same cross section. This armature part 19 is, as is shown by dashed lines in FIG. 2*a*, a planar sheet metal part and has two hook-like projections 20, 21 lying diametrically opposite one another. A resilient circumferential latching element 22 which protrudes downward is integrally formed onto the plastic housing 8 by injection molding below the bottom part 9. The projections 20, 21 have oblique faces 24, 25 on their upper sides. The armature part 19 is already soldered, together with the base plate 5, to the collector when the condenser leaves the oven after soldering/brazing. The tube 4 is then specifically still open at the top, i.e., the plate 6 is not yet soldered in, in contrast to the illustration in FIG. 1. The complete dryer/filter cartridge 7, that is to say with the granulate and filter sieve 16 filled in, is then inserted into the tube 4 through this opening until the bottom end of the resilient latching element 22 slides onto the oblique faces 24 and 25 and is thus spread apart. The dryer/filter cartridge 7 is then pressed further downward in the direction of the bottom plate 5 until the latching element 22 clicks inward and engages behind the hook-shaped projections 20 and 21 in a positively locking fashion. The dryer/filter cartridge 7 then rests with its bottom part 9 on the armature part 19 and is secured, by the latching element 22, against moving in the direction of the longitudinal axis of the tube 4. The armature part 19 and latching element 22 thus form a clip connection.

After the dryer/filter cartridge 7 has been securely positioned in the tube 4 by this clip connection, the disk 6 is inserted into the pipe 4 and soldered or nondetachably connected to the pipe 4 in a pressure-tight fashion in some other way. The condenser is then in the finished mounted state.

The invention claimed is:

1. A condenser for a motor vehicle air-conditioning system, comprising a block of finned tubes; header tubes which are arranged on opposing sides of the tube block and which receive respective ends of the finned tubes; a collector which is arranged in parallel with a first one of the header tubes and which is in fluid communication with said first header tube; and a dryer/filter cartridge positioned inside of the collector, wherein the collector comprises a first soldered-in closure part non-detachably closing a first end of the collector, wherein the dryer/filter cartridge is mechanically connected to the first closure part, and wherein the collector comprises a second closure part non-detachably connected to and closing the second end of the collector.

2. The condenser as claimed in claim 1, wherein the first closure part is located at the bottom of the collector.

3. The condenser as claimed in claim 1, wherein the dryer/filter cartridge is connected to the closure part via a resilient latching connection.

4. The condenser as claimed in claim 3, wherein the resilient latching connection comprises at least one armature which is soldered into the first closure part and which includes a portion for cooperating with a resilient latching element located on the dryer/filter cartridge.

5. The condenser as claimed in claim 4, wherein the dryer/filter cartridge is comprised of a plastic cage having a bottom part on which the latching element is integrally formed.

6. The condenser as claimed in claim 5, wherein the fluid communication between the first header tube and the collector takes place via two spaced openings in the wall of the collector, and wherein the dryer/filter cartridge includes a circumferential sealing lip positioned axially on the cartridge so as to lie in the region between the openings.

7. The condenser as claimed in claim 6, wherein the dryer/filter cartridge comprises a sieve arranged on the circumference of the plastic cage in the region below the sealing lip.

8. The condenser as claimed in claim 1, wherein a gap is present between the dryer/filter cartridge and an inner wall of the collector, said gap being spanned at least in part by a spacer element.

9. The condenser as claimed in claim 1, wherein the dryer/filter cartridge is mechanically connected to the first closure part after said first closure part has been soldered-in to the collector.

10. A method for manufacturing a condenser as claimed in claim 1, comprising:

brazing together in an oven assembled condenser components comprising the block of finned tubes, the header tubes, the collector and a single one of the closure parts comprising said first closure part, whereby the collector end closed by the second closure part is left open;

installing the dryer/filter cartridge into the collector through the open end and attaching the cartridge to the first closure part; and non-detachably closing the open end of the collector by means of the second closure element.

11. The method as claimed in claim 10, wherein the step of non-detachably closing the open end comprising soldering the second closure element into the open end of the collector.

12. A soldered condenser for a motor vehicle air-conditioning system having a block of finned tubes; collector pipes which are arranged on both sides of the block and which receive respective ends of the tubes; a collector which is arranged in parallel with a first collector pipe and which is in fluid communication with the first collector pipe via two openings; and a dryer/filter cartridge located in the collector, wherein the collector has a first soldered-in closure part, wherein the dryer/filter cartridge is mechanically connected to the first closure part via a clip connection, wherein a second closure part is non-detachably connected to the collector, wherein the clip connection has at least one armature which is soldered into the closure part and behind which a resilient latching element of the dryer/filter cartridge engages; and wherein the dryer/filter cartridge is comprised of a plastic cage with a bottom part on which the latching element is integrally formed.

13. The condenser as claimed in claim 12, wherein the dryer/filter cartridge has a circumferential sealing lip in a region between the openings.

14. The condenser as claimed in claim 13, further comprising a sieve arranged on the plastic cage on the circumference in a region below the sealing lip.

* * * * *